US008043062B2

(12) United States Patent
Ichiryu

(10) Patent No.: US 8,043,062 B2
(45) Date of Patent: Oct. 25, 2011

(54) TURBINE ROTOR AND TURBINE HAVING THE SAME

(75) Inventor: Taku Ichiryu, Akashi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 605 days.

(21) Appl. No.: 12/204,145

(22) Filed: Sep. 4, 2008

(65) Prior Publication Data

US 2010/0054943 A1 Mar. 4, 2010

(51) Int. Cl.
*F04D 29/00* (2006.01)

(52) U.S. Cl. ..... 416/198 A; 416/204 A; 416/204 R

(58) Field of Classification Search ..... 416/198 A, 416/204 A, 220 R
See application file for complete search history.

(56) References Cited

U.S. PATENT DOCUMENTS

| | | | | |
|---|---|---|---|---|
| 4,832,574 | A * | 5/1989 | Woodwell et al. | 416/244 A |
| 6,287,079 | B1 | 9/2001 | Gosling et al. | |
| 6,435,831 | B1 | 8/2002 | Ichiryu | |
| 6,499,957 | B1 * | 12/2002 | Klingels et al. | 416/198 A |
| 7,390,170 | B2 * | 6/2008 | Charrier et al. | 416/198 R |
| 7,661,931 | B1 * | 2/2010 | Matheny | 416/220 R |
| 7,686,571 | B1 * | 3/2010 | Matheny | 415/9 |
| 2004/0042896 | A1 * | 3/2004 | Akiyama et al. | 415/110 |
| 2004/0086377 | A1 * | 5/2004 | Proctor et al. | 415/116 |
| 2004/0170498 | A1 * | 9/2004 | Peterman et al. | 416/97 R |
| 2007/0212192 | A1 * | 9/2007 | Shirk et al. | 411/166 |

FOREIGN PATENT DOCUMENTS

JP 2001-3702 A 1/2001

* cited by examiner

*Primary Examiner* — Alexander Ghyka
(74) *Attorney, Agent, or Firm* — Westerman, Hattori, Daniels & Adrian, LLP

(57) ABSTRACT

A turbine rotor is provided with a torque transfer mechanism equipped between a pair of adjacent rotor discs among a plurality of rotor discs so as to transfer a torque from one rotor disc to another rotor disc. The torque transfer mechanism is provided with a first groove having a semi-circle in cross section formed on a first contact face of one rotor disc, and a second groove having a semi-circle cross section formed on a second contact face of another rotor disc, and a torque pin inserted into cylindrical holes formed by combining the first grooves and the second grooves. The flange of the torque pin has long sides and short sides, and the length of the short sides is shorter than the width of an binary flange receiving plane formed by a pair of outer circumference planes of adjacent two rotor disc along the circumferential direction, and the long side of the flange has a longer length than the width of the binary flange receiving plane. A pair of flange receiving recessed portions is provided for receiving the end portions of the long sides of the flange on both side walls of the binary flange receiving plane.

6 Claims, 9 Drawing Sheets

TURBINE ROTOR AND TURBINE HAVING THE SAME

BACKGROUND OF THE INVENTION

1. Field of the Invention

The present invention relates to turbine rotors of turbines for industrial applications and a gas turbine having the turbine rotors.

2. Description of Related Art

The present invention is applied to turbines for industrial applications including a gas turbine and a steam turbine. Hereinafter, a description will be given of an example in which the turbine rotor of the present invention is applied to the gas turbine.

First, FIG. 7 shows a general structure of the gas turbine. In the gas turbine, air is compressed by a compressor 101, the thus compressed air is introduced into a combustor 102, a fuel is fed into the combustor 102 to generate a combustion gas, and the thus generated combustion gas is introduced into a turbine 103 to rotate the turbine for obtaining electricity from a generator 104.

In general, a turbine rotor is connected with a compressor rotor through an intermediate shaft for connecting both axes, such that they are driven coaxially trough the coaxial axis and driven coaxially.

The compressor rotor and the turbine rotor are both an assembly of rotor discs constituted by stacking disc-like rotor discs inline with an axial line direction of the rotor and fixing them by a bolt. That is, in the compressor rotor, respective blades of the disc-like rotor discs are mounted in a radial direction on the outer circumference and stacked in the axial direction of the rotor, and each of the rotor discs is integrally fixed by a spindle bolt that penetrates through the axial direction of the rotor. This structure is also the same as that in the turbine rotor. The structure is found not only in a rotor for the gas turbine but also in a rotor for the steam turbine.

As shown in FIG. 8, annular projected portions 52 arranged in a concentric manner with a rotor disc 50 are formed at a flat-plate like side-face portion 51 of the rotor disc 50. The projected portion 52 is approximately rectangular in the cross section, and the annular projected portion 52 is projected in parallel to the center axis of a rotor shaft. Further, the projected portion 52 is constituted with a central side face 53 facing the rotor shaft, an outer circumference side face 54 facing the outer circumference of the rotor disc 50 and a top face 55 that is in contact with an adjacent rotor disc (not illustrated). When a plurality of rotor discs 50 are stacked, with the centers thereof in alignment with each other, the top face 55 of the projected portion 52 is in contact with the top face of the projected portion of an adjacent rotor disc. Then, a spindle bolt (not illustrated) is inserted into a bolt hole 60a drilled in the rotor disc 50 to fasten a plurality of the rotor discs 50 integrally, by which the top faces of the projected portions are in press contact with each other by a fastening force of the spindle bolt.

Further, a plurality of grooves 33, the cross section of which is semi-circular, are formed on the top face 55 of the projected portion 52 at which the respective rotor discs 50 are in press contact with each other. At the time of assembling a turbine rotor and when one rotor discs is in contact with the adjacent rotor disc, the center of the groove 33 formed on the top face 55 in the radial direction of the projected portion 52 of one rotor disc 50 is aligned with the center of the other groove 33 formed on the top face 55 of the projected portion 52 of the other adjacent rotor disc 50, a cylindrical hole 35 penetrating through the top face 55 is formed in the radial direction by two projected portions 52 of a pair of top faces 55 which is in press contact with each other.

When the turbine rotor is assembled, a columnar torque pin 40 is inserted into the cylindrical hole 35. The torque pin 40 has functions to prevent adjacent rotor discs 50 from being disengaged in the rotational direction and the torque pin has a role to transfer a rotational torque from one rotor disc 50 to another adjacent rotor disc 50.

The torque pin 40 is provided with a cylindrical main body 41 and flanges 42, 43 attached on both ends of the main body 41 and the diameter of the torque pin 40 is greater than that of the main body 41. The flange 42 is arranged at the center of the rotor disc 50 to prevent the torque pin 40 from coming off in the radial direction due to centrifugal forces during operation. The flange 43 which is arranged on the outer circumference of the rotor disc 50, is to prevent the torque pin 40 from dropping down due to its own weight when the operation of the rotor is terminated.

Further, when an additional torque is applied to the turbine rotor 1 from one end thereof, the rotor blade assembly absorbs the torque corresponding to the additional load. In a case that the load is a generator, a torque which is several times higher than a rated load, is applied, and since a load (for example, a generator) is connected to the other end of the turbine rotor 1, the load must be absorbed by friction of top faces 55 of the rotor disc 50 and the torque pin 40.

It is necessary that all the torque pins 40 are fitted into the cylindrical holes 35 leaving no space. Therefore, after a plurality of rotor discs 50 are stacked and fastened by the spindle bolt 60 to fix the rotor discs 50 integrally, it is necessary to form a plurality of cylindrical holes 35 for connecting rotor discs for stabilization of respective rotor discs. Each cylindrical hole is formed extending two top face of the two top faces of a pair of projected portions 52 of a pair of adjacent rotor discs, the top faces 55 of the pair of adjacent rotor discs are in press contact with each other. Japanese Unexamined Patent Application No. 2001-3702 has disclosed in a specific manner an example of the above-described rotor disc.

However, in order to insert the torque pins 40 into the cylindrical holes 35 after formation of the cylindrical holes 35, it is necessary to disassemble a rotor which has been once assembled. In other words, the rotor is disassembled to separate adjacent rotor discs 50, to thereby the torque pins 40 are inserted into the grooves 33. Thereafter, the rotor discs 50 are again assembled and fastened by the spindle bolt 60, in order to integrate the rotor discs 50 into a single unit. As described above, the turbine rotor has to be disassembled and has to be reassembled, thus the assembly operation was complicated.

According to the invention disclosed in U.S. Pat. No. 6,287,079, as shown in FIG. 9, after a plurality of rotor discs are stacked and fastened into a single unit, circular holes 81 are formed between two projected portions of a rotor disc on which top faces 55 are pressed against each other. Thereafter, torque pins 70 can be inserted from the outside of the assembled rotor disc into cylindrical holes formed between two projected portions of the rotor disc, thereby it becomes possible to simplify the assembly of the turbine rotor by omitting one step of the assembly operation.

Specifically, circular holes 81 are formed at both projected portions of the rotor disc 50 on which the top faces 55 are pressed against each other, and the torque pins 70 are attached into the circular holes 81. A cam 72 attached to a main body 71 of the torque pin 70 is rocked at the center of a pivot pin 73 by pressing a dump bolt 74 and fitted into a groove 82 disposed on the circular hole 81 drilled on the rotor disc side. As a result, the rotor disc 50 and the torque pin 70 are kept engaged via the cam 72 and will not fall out even if a centrifugal force acts on the torque pin 70.

However, it is difficult to carry out machining operation for the above-described complicated structure. For example, It is necessary to drill a circular hole through an assembled structure, in which a plurality of the rotor discs 50 are fixed integrally and thereafter, to form the groove 82 in the small inner wall face inside the circular hole 81. It is quite difficult and also time-consuming to form the groove as described above. Further, in a structure in which the cam 72 rotates around the center of the pivot pin 73, the cam is likely to be heated and stacked by a high temperature atmosphere and may become made unworkable within a short time. It is, therefore, not always possible to guarantee the reliable operation.

An object of the present invention is to provide turbine rotors and a turbine in which the two-time assembly work of the turbine rotors can be avoided to greatly reduce the number of man-hours necessary for assembly. Another object of the present invention is to provide a structure which reduces the number of components and the number of steps in processing, and the number of man-hours necessary for assembly of turbine rotors, as well as to be capable of securing the operation, as compared with the invention disclosed in U.S. Pat. No. 6,287,079.

SUMMARY OF THE INVENTION

The turbine rotor of the present invention is provided with a torque transfer section disposed between any adjacent rotor discs, among a plurality of rotor-discs stacked in the axial line direction, with the centers in alignment with each other, and fixed integrally, thereby transferring torque from one rotor disc to another rotor disc. The turbine rotor is provided with a first contact surface which is formed on a first rotor disc facing a second rotor disc; a plurality of first grooves arranged on the first contact face so as to be separated from each other along the circumferential direction of the first rotor disc, formed individually in the radial direction of the first rotor disc and have a semi-circle cross-section orthogonal to the radial direction; a second contact surface which is formed on the second rotor disc adjacent to the contact face the first rotor disc; a plurality of second grooves which are arranged on the second contact face so as to separate from each other along the circumferential direction of the second rotor disc formed individually in the radial direction of the second rotor disc, and have a semi-circle cross-section orthogonal to the radial direction; a plurality of torque pins which are inserted into a plurality of cylindrical holes, one of which is formed by a pair of first and second contact faces when the first rotor disc is in contact with the second rotor disc; and a binary flange-receiving plane which is formed on the outer circumferences of the adjacent first and second rotor discs along the circumferential direction. A torque pin is consisted of a columnar main body and a flange having a long side and a short side and the flange is joined to the main body. The length of the long side of the flange is greater than the width of the binary flange receiving plane, while the length of the short side is smaller than the width of the binary flange receiving plane. A flange receiving recessed portions of the binary flange receiving plane are capable of receiving the arc-shaped edge of the long side are formed respectively on the two side faces of the binary flange receiving plane which face each other.

According to the turbine rotor of the present invention, a torque pin is inserted into a cylindrical hole formed by the binary flange receiving plane from outside of the rotor disc in a rotatable manner, so that the long side of the flange of the torque pin is inserted into the flange receiving recessed portion on the binary flange receiving plane surface, and the flange is engaged with the flange receiving recessed portion. The torque pin is then fixed to a rotor disc. Therefore, although the engaging structure is simple, the torque pin can be fitted to the assembled rotor. As a result, it is possible to avoid complicated assembly operations.

In the turbine rotor of the present invention, the flange is a plate approximately in a circular shape which has two circular arc portions and two linear portions separated in parallel between two circular arc portions. The long side of the flange may include two circular arc portions at the both edges thereof, and the short sides on both sides of the long sides are formed by two circular arcs.

According to the turbine rotor of the present invention, the structure of the torque pin is simple. However, the torque pin is capable of assuring the reliable construction of the turbine rotor without falling into a danger of breakage.

In the turbine rotor of the present invention, each of the flange receiving recessed portions may be formed in an arc-shaped grooves and spacing between two flange receiving recessed portions facing each other intervening the centers of the cylindrical holes can be longer than the length between the two circular arc portions of the flange.

According to the turbine rotor of the present invention, when a groove as the flange receiving recessed portion is formed on the narrow binary flange receiving plane surface when two rotor discs are integrally fixed, it is possible to form a groove in any depth of groove, which is greater than a distance between the two circular arc portions of the flange. Thus, there is a degree of freedom in selecting tools. Accordingly, the groove as the flange receiving recessed portion can be formed easily.

In the turbine rotor of the present invention, the flange receiving recessed portion may be an annular groove where an axial center of the rotor disc is at the center thereof.

According to the turbine rotor of the present invention, the flange receiving recessed portion is a simple annular groove, that can be formed easily even on the narrow binary flange receiving plane face.

As the alternative example of the turbine rotor according to the present invention, it is possible to form a first projected portion on the outer circumference of the first rotor disc along the circumferential direction and to form a second projected portion on the outer circumference of the second rotor disc along the circumferential direction. It is also possible to form the binary flange receiving plane between the first projected portion and the second projected portion, and to form the flange receiving recessed portions respectively on a side face facing the second projected portion of the first projected portion and also on a side face of the second projected portion facing the first projected portion.

According to the turbine rotor of the present invention, since the binary flange receiving plane is formed between the first projected portion and the second protruded portion, it is possible to decrease the thickness of a rotor disc to be processed for machining the binary flange receiving planes, which results in decreasing the heat capacity of respective rotor discs and also decreasing the weight of respective rotor discs.

The turbine of the present invention is provided with the above-described turbine rotors. The turbine of the present invention is constituted by turbine rotors that can be assembled at reduced total man-hours, and that can be reliably driven.

DETAILED DESCRIPTION OF THE PREFERRED EMBODIMENTS

An embodiment of the present invention will be described hereinafter with reference to the drawings. Only one embodiment of the present invention will be described hereinafter. However, the present invention shall not be limited to the embodiment described hereinafter. Further, the following embodiment includes components, which can be easily replaced by a person skilled in the art and which are substantially the same. Still further, the turbine rotor of the present invention is applicable to a rotor for a gas turbine and for a steam turbine.

Hereinafter, an embodiment of the present invention will be described by exemplifying a rotor for a gas turbine.

Figure 1:
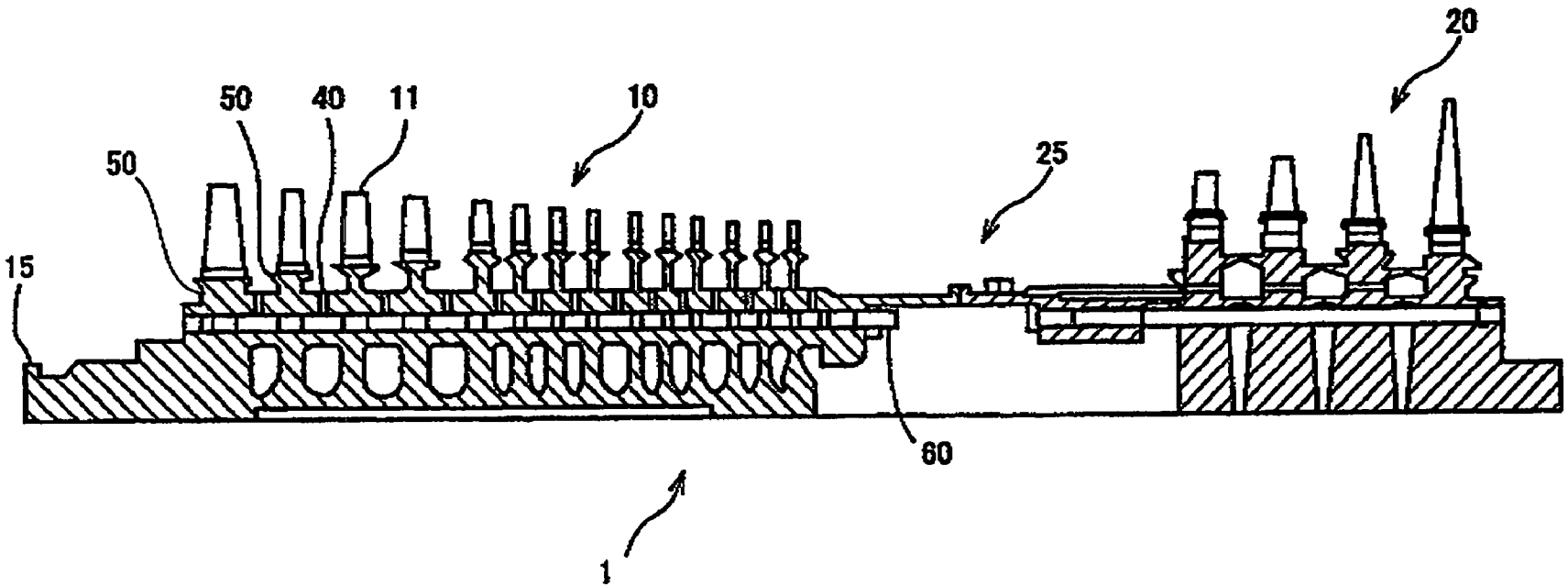
FIG. 1 is a side sectional view of a turbine rotor of one embodiment of the present invention.

As shown in FIG. 1, the turbine rotor 1 of the present embodiment is provided with a compressor rotor 10, a turbine rotor 20, and an intermediate shaft 25 connecting the compressor rotor 10 with the turbine rotor 20. They are assembled integrally along the central axis. The compressor rotor 10 is provided with a plurality of rotor discs 50 having a rotor blade 11 at the leading end and a spindle bolt 60 for stacking and fixing the rotor discs 50.

The rotor 10 of the compressor and the turbine rotor 20 are both assembled rotors, which are assembled by stacking disc-shaped rotor-discs 50 in the axial direction and by binding the stacked rotor-discs with a through spindle bolt 60. That is, the compressor rotor 10 is composed of disc-like rotor discs 50, which comprises respective rotor blades 11 mounted in the radial direction on the outer circumference, are stacked in the axial direction of the rotor, and each of the rotor discs 50 is fixed integrally by the spindle bolt 60 penetrating through the axial direction of the rotor. This structure is also found in the turbine rotor 20. The structure is found not only in a rotor for a gas turbine but also in a rotor for a steam turbine. A gas turbine includes the above-described turbine rotor 1, together with a stator portion of the compressor, a stator portion of the turbine, and the combustor and the like.

Next, a structure of the rotor portion 10 of the compressor will be described hereinafter in detail. This structure is also applicable to the rotor portion 20 of the turbine. It is noted that, for a pair of adjacent rotor discs, a common reference symbol of "a" is affixed to one component in one pair of rotor discs, while a reference symbol of "b" is affixed to another rotor disc in the same pair of rotor discs.

The turbine rotors 1 of the present embodiment is provided with a plurality of torque transfer mechanisms, which is constituted by a binary flange receiving plane and a torque pin. The binary flange receiving plane for the torque transfer mechanism is provided between respective pairs of adjacent rotor discs 50 arranged at equal intervals in the circumferential direction, among a plurality of the rotor discs 50 stacked and fastened in the axial direction of the rotor, with the centers in alignment with each other. The torque transfer mechanism is to transfer a torque from one rotor disc 50*a* to another rotor disc 50*b* (or from the rotor disc 50*b* to the rotor disc 50*a*).

Each of the torque transfer mechanisms comprises a torque pin and a binary flange receiving plane. The binary flange receiving plane is formed by one groove (first groove) 33*a* formed on a top face (first contact face) 55*a* of one rotor disc 50*a* facing the adjacent top face of the other rotor disc 50*b*, and by another groove (second groove) 33*b* formed on a top face (second contact face) 55*b* of the rotor disc 50*b* facing the rotor disc 50*a*, and the torque pin.400 is inserted into a cylindrical hole 35, that is, a binary flange receiving plane, formed by aligning the groove 33*a* with the groove 33*b*. Each of the grooves 33*a*, 33*b* has a semi-circular-shaped cross section.

Actually, after a plurality of the rotor discs 50 are stacked and fastened into a single unit, a plurality of cylindrical holes 35 are formed radially at the projected portions 52*a*, 52*b* on which the top faces 55*a*, 55*b* are pressed against each other. Accordingly, a plurality of binary flange receiving planes 35*a* are formed radially on the top faces 55*a*, 55*b* of mutually adjacent two rotor discs 50*a*, 50*b*.

Figure 2A:
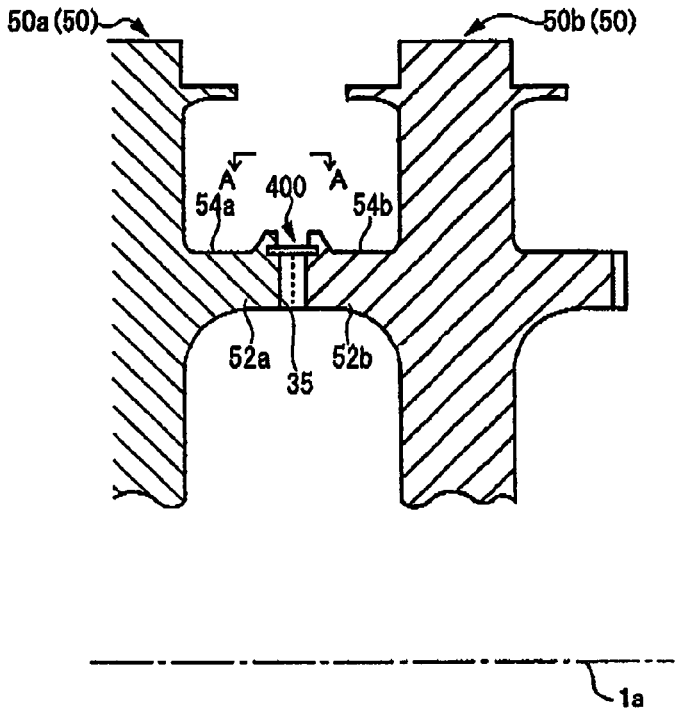
FIG. 2A is a sectional view showing major parts of a rotor disc according to one embodiment of the present invention.
Figure 2B:
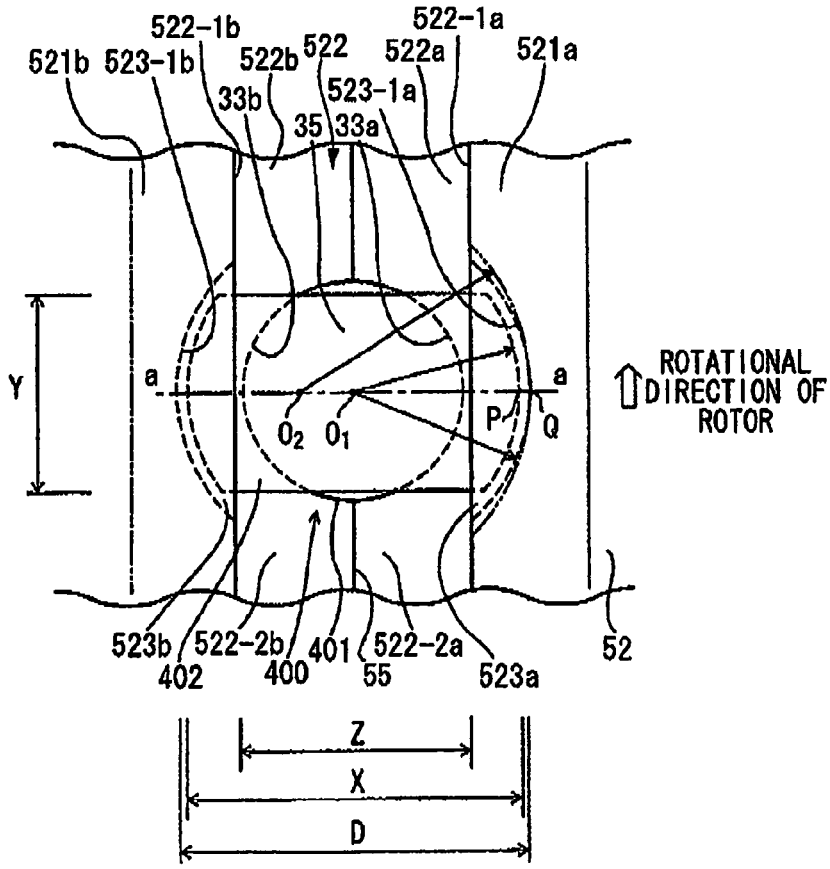
FIG. 2B is a sagittal sectional view taken along Line A to A of FIG. 2A.
Figure 3:
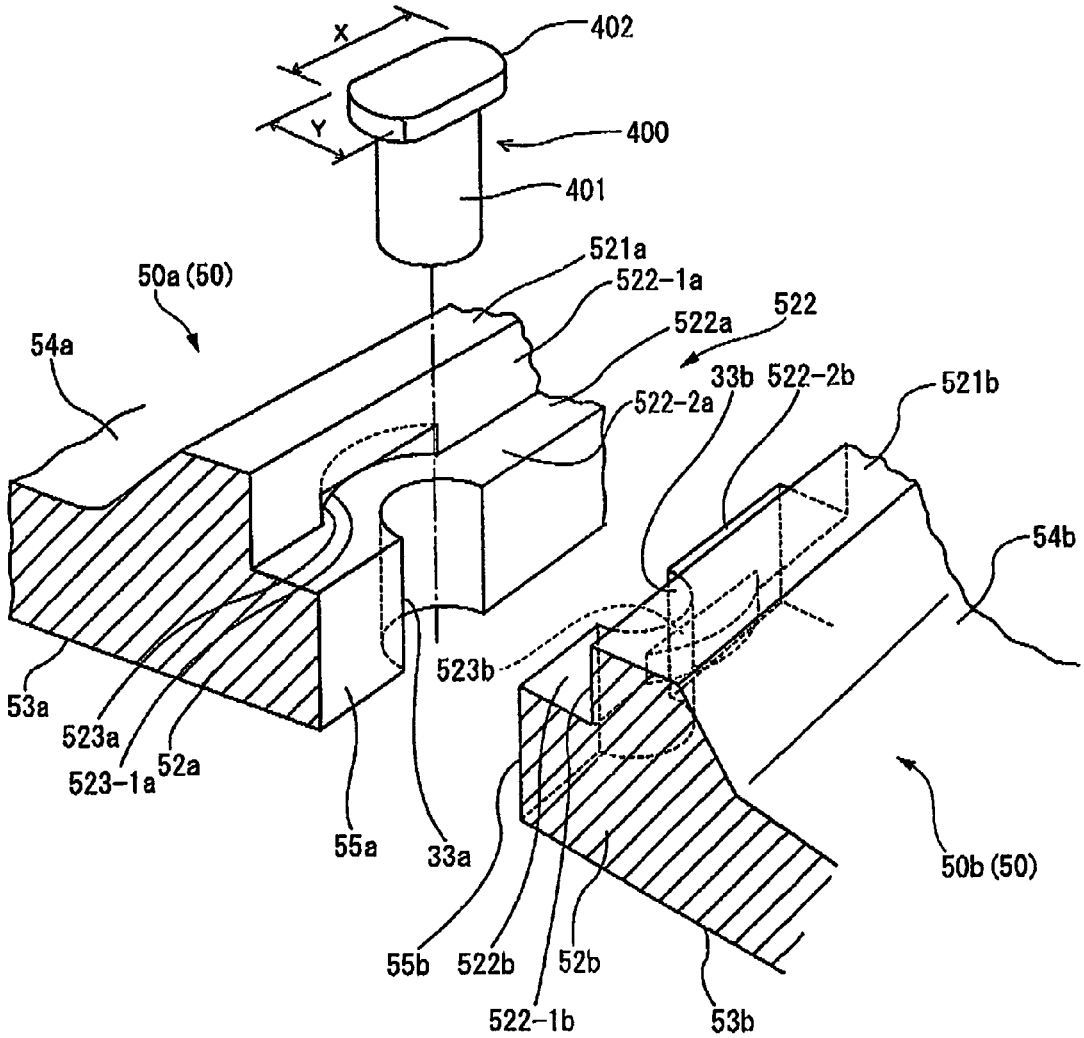
FIG. 3 is a perspective view showing a projected portion of the rotor disc and the surroundings thereof.

As shown in FIG. 2A, FIG. 2B and FIG. 3, in one rotor disc 50*a*, an annular flange receiving projected portion (first projected portion) 521*a* is formed along the circumferential direction of the rotor disc 50*a* on the outer-circumference side face 54*a*, in the vicinity of the top face (first contact face) 55*a* of the projected portion 52*a*. In the other rotor disc 50*b* an annular flange accepting protruded portion (second protruded portion) 521*b* is formed along the circumferential direction of the rotor disc 50*a* on the outer-circumference side face 54*b* in the vicinity of the top face (second contact face) 55*b* of the projected portion 52*b*.

An annular plane 522*a* for receiving the flange of the torque pin is formed between in front of the flange receiving projected portion 521*a* and on the top face 55*a* along the outer circumference face of the rotor disc 50*a*. An annular plane 522*b* is also formed along the outer circumference face of the rotor disc 50*b* in front of the flange receiving projected portion 521*b* and on the top face 55*b*. When the top face 55*a* of the rotor disc 50*a* is brought into contact with the top face 55*b* of the rotor disc 50*b*, the plane 522*a* is connected with the plane 522*b*, so that a binary plane 522 having a width of Z is formed. The binary plane 522 is formed annularly on the outer circumference faces of the rotor discs 50*a*, 50*b* when the contact faces (top faces 55*a*, 55*b*) are brought into contact with each other. The width of Z of the binary plane 522 is at least greater than the hole diameter of the cylindrical hole 35.

An alternative of the above embodiment will be described hereinafter. It may be possible for outer-circumference side faces 54*a*, 54*b* to be flat faces in the direction of the rotor shaft la, without forming flange receiving recessed portions 521*a*, 521*b* in the binary rotor discs 50*a*, 50*b*. In this case, in order to form respective flange receiving recessed portions 523*a*, 523*b* near the top faces 55*a*, 55*b*, it is necessary to provide the projected portions 52*a*, 52*b* having a certain thickness (height in the radial direction) in the vicinity of the top faces 55*a*, 55*b*. However, since it is not necessary to form a projected portion with a certain thickness except for the portion to form the flange receiving recessed portions 523*a*, 523*b*, the thickness of the projected portions 52*a*, 52*b* can be decreased. Since the thickness of the projected portions 52*a*, 52*b* can be decreased, an advantage is obtained such that the weight of the rotor discs 50*a*, 50*b* can be reduced and the heat capacity of the rotor disc can be reduced.

Further, a groove-shaped flange receiving recessed portion 523*a*, which is capable of receiving the flange 402 of the torque pin 400, is formed on one side wall face 522-1*a* on one side of the binary flange receiving plane 522*a*, and a groove-shaped flange receiving recessed portion 523*b*, which is capable of receiving the flange 402 of the torque pin 400, is also formed on the other side wall face 522-1*b* on the binary flange receiving plane 522*b*. The side wall face 523-1*a* of the flange receiving recessed portion 523*a* is formed on the surface 522*a* so as to be concentric with the cylindrical hole 35 and formed in an arc shape having a diameter, which is slightly greater than the diameter (X) of the flange 402 of the torque pin 400. Furthermore, the side wall face 523-1*b* of the flange receiving recessed portion 523*b* is formed on the surface 522*b* to be concentric to the cylindrical hole 35, similar to the side wall face 523-1*a* of the flange receiving recessed portion 523*a*. Further, each of the flange receiving recessed portions 523*a*, 523*b* has a groove width capable of sufficiently receiving the flange 402 of the torque pin 400.

A specific description will be given by referring to FIG. 2B. FIG. 2B is a sectional view at the time when the torque pin 400 is inserted into the cylindrical hole 35, which is formed when a pair of rotor discs is in contact with each other. The center of the cylindrical hole 35 is designated as $O_1$, the point at which a straight line of a-a in parallel with a rotor shaft line through the center $O_1$ intersects the outer circumference circular-arc shape of the flange 402 of the torque pin 400 is designated as P, and the point at which the straight line of a-a intersects the side wall face 523-1*a* of the flange receiving recessed portion 523*a* is designated as Q. The side wall face 523-1*a* of the flange receiving recessed portion 523*a* is concentric with the cylindrical hole 35 and formed so as to depict a circular arc, the radius (the distance between the center $O_1$ and the point Q) of which is slightly greater than the maximum radius (a distance between the center $O_1$ and the point P) of the flange 402. Further, the side wall face 523-1*a* may not necessarily be concentric with the cylindrical hole 35. Another option is that the side wall face 523-1*a* is, for example, a circular arc greater than a maximum radius of the flange 402 and the center $O_2$ thereof is on the straight line of a-a and formed so as to depict a circular arc with any given radius (the distance between the center $O_2$ and the point Q), passing through the point Q. The side wall face 523-1*b* of the flange receiving recessed portion 523*b* is also the same in structure as the above-described side wall face 523-1*a*.

Further, the flange receiving recessed portions 523*a*, 523*b* may not necessarily be in a circular arc shape. As long as they do not interfere with the rotational track of the flange, they may be formed in other curved shapes or in a rectangular shape with a flat bottom. As described above, the degree of freedom in shape of a groove will allow a wider range of tools to be selected and used, thus making it possible to form the flange receiving groove more easily.

Figure 4A:
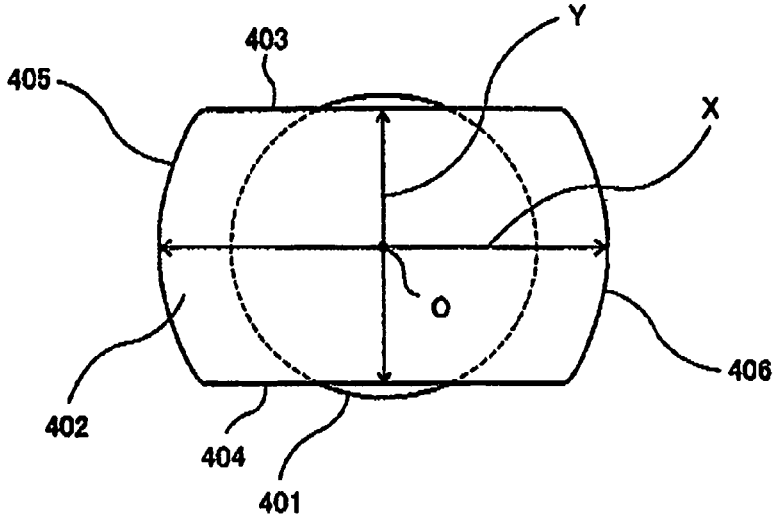
FIG. 4A is a plan view of a torque pin.
Figure 4B:
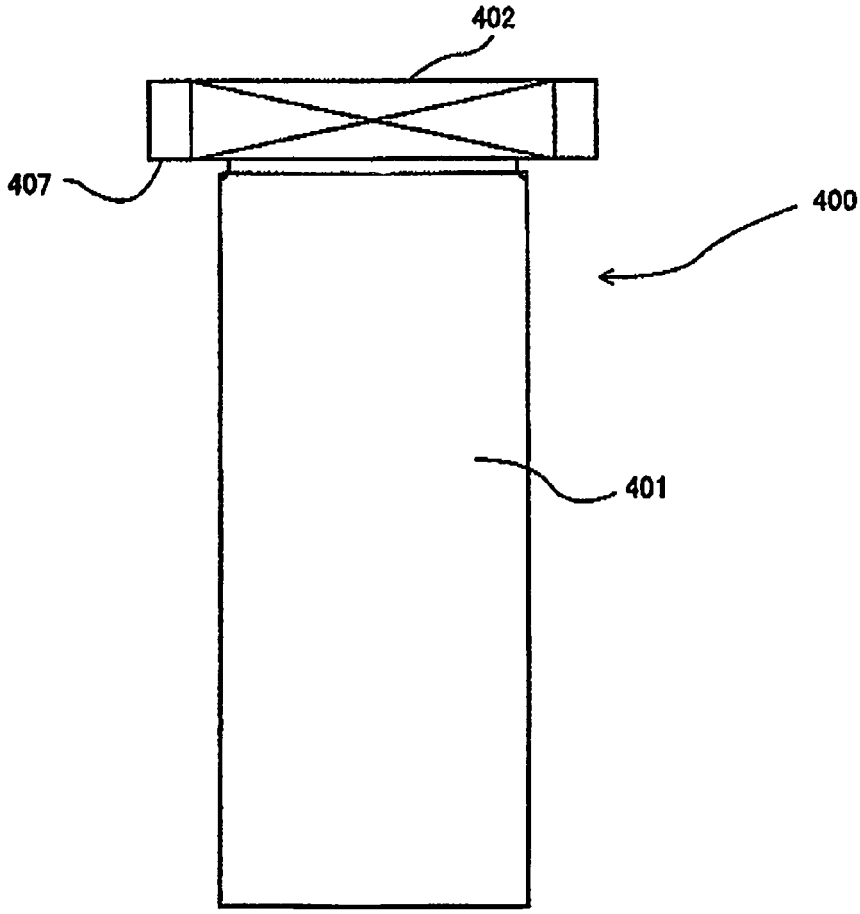
FIG. 4B is a side view of the torque pin.

The shape of the torque pin 400 is shown in FIG. 4A and FIG. 4B. The torque pin 400 is constituted with a columnar main body 401 and a flange 402 having a long side and a short side and joined on one end of the main body 401. The flange 402 is formed approximately in a circular plate shape concentric with the main body 401 (center O) and provided with two circular arc-shaped short sides 405, 406 and two linear long sides 403, 404 which form both long sides intervening two circular arc sides 405, 406. The long side and short side of the flange 402 are both longer than the main body 401. The two circular arc portions 405, 406 constitute long sides, while the two linear portions 403, 404 constitute the short sides. The distance X between these two circular arc portions 405, 406 is equal to the diameter of the flange 402. The distance Y between these two linear portions 403, 404 is shorter than the diameter of the flange 402. It is noted that the flange 402 may be disposed not on the end of the main body 401 but at an intermediate part thereof, as long as it functions as the torque pin of the present invention.

The long side and the short side of the flange 402 will be described in more detail with reference to FIGS. 2A, 4A and 4B. Both linear long sides are terminated by two circular arc portions 405, 406, and the width between two circular arc portions is the maximum width X of the flange 402. The long sides have a width X, which is equal to the diameter of the flange 402 and the center line along the long sides passes through the center O of the main body 401. The width of the short side has the minimum width Y of the flange 402 and both short sides are formed in the shape of arc. The short side width Y is shorter than the diameter X of the flange 402. The width X of the long side of the flange 402 is greater than the width Z of the binary flange receiving plane 522, and the width Y of the short side is smaller than the width Z of the inter-disc groove 522. Furthermore, the width Y of the short side is formed to be equal to or slightly smaller than the width of the main body 401. When the width Y of the short side is made greater than the diameter of the main body 401, it is necessary to increase the width of the long side. As a result, it becomes necessary to increase the width Z of the inter-disc groove 522, which is not economical. A method for fitting the torque pin 400 will be described later. Sine the torque pin 400 is formed as described above, the torque pin 400 can be easily fitted into the cylindrical hole 35 from outside of the rotor disc in the radial direction. The shape of the flange 402 is not limited to the above-described shape, as long as the flange 402 is provided with the long side and the short side. For example, the flange may be formed in an oval, a rectangular or a polygonal shape. Further, the long side of the flange 402 may not necessarily be linear portions separated in parallel. The long side of the flange 402 may optionally be a combination of curved sides, as long as it satisfies the above conditions.

Hereinafter, a process step for fitting the torque pin 400 to the turbine rotor 1 is described. First, after a plurality of rotor discs are stacked and fastened into a unit, cylindrical holes 35 are formed between a pair of projected portions 52*a*, 52*b* wherein the top faces 55*a*, 55*b* are pressed with each other. A pair of flange receiving recessed portions 523*a*, 523*b* are respectively formed on the side wall faces 522-1*a*, 522-1*b* of the binary flange receiving plane 522. The flange receiving recessed portion may be formed on each of the rotor discs before the rotor discs are assembled.

Next, the torque pin 400 is inserted into the cylindrical hole 35. At the time of inserting the torque pin 400, the linear portions 403, 404 constituting the long sides of the flange 402 must be maintained in parallel to the side wall faces 522-1*a*, 522-1*b* of the binary flange receiving plane 522. Since the width Y in between two short sides is smaller than the width Z of the binary flange receiving plane 522, it is possible to insert the torque pin 400 into the cylindrical hole 35 without interference of the flange 402 by the side wall faces 522-1*a*, 522-1*b*.

After the torque pin 400 is inserted until the lower face 407 of the flange 402 is in contact with the upper faces 522-2*a*, 522-2*b* of the binary flange receiving plane 522, the flange 402 is rotated by almost 90 degrees, so that the arc portions 405, 406 of the flange are inserted respectively into the flange receiving recessed portions 523*a*, 523*b*. After the torque pin 400 is held in both flange receiving recessed portions, a stopper pin (not illustrated) for stopping rotation of the flange is fitted into the flange 402, etc., so that the torque pin 400 is fixed to the cylindrical hole 35. After the rotor discs 50 are stacked and fixed into one unit by fitting the spindle bolt, then, as described above, the torque pin 400 is fixed to the cylindrical hole 35, and the turbine rotor is finally assembled.

In the above-described procedures, when the torque pin 400 is inserted into the cylindrical hole 35 and rotated by almost 90 degrees, the circular arc portions 405, 406 constituting the edges of the long side of the flange 402 are respectively inserted into the flange receiving recessed portions 523*a*, 523*b* and the flange 402 is engaged on the binary flange receiving plane 522. Therefore, the torque pin 400 will not drop down due by its own weight while the turbine is out of operation and the torque pin 400 will not fall out in the radial direction of the rotor disc due to centrifugal force acting on the torque pin 400 during operation.

Furthermore, the number of components of the rotor disc assembly of the present invention is far reduced than the number of components of the rotor disc according to U.S. Pat. No. 6,287,079. In addition, the rotor discs can be securely fastened by the use of the torque pin. Still further, the turbine rotor can be easily assembled and grooves such as flange receiving recessed portions can also be easily formed.

Figure 5:
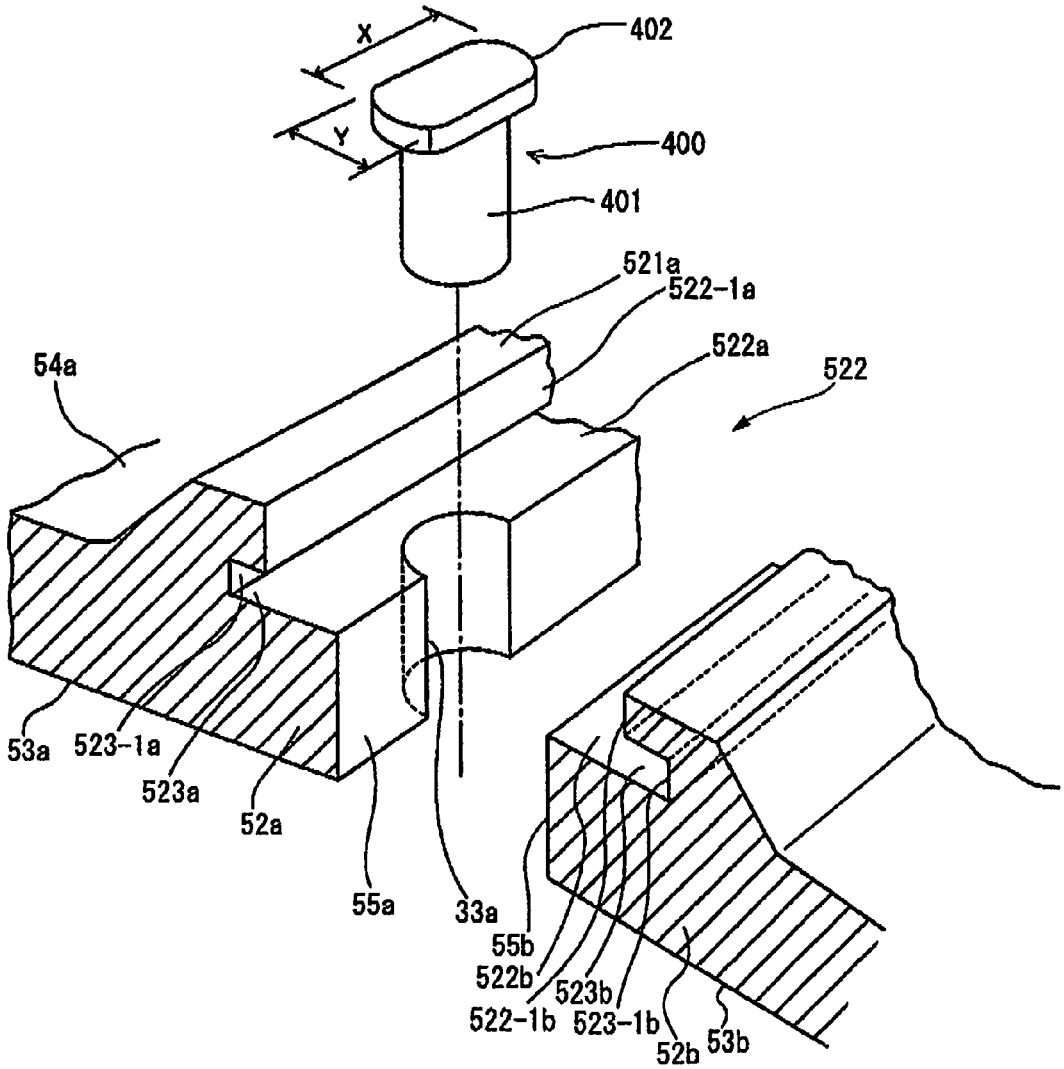
FIG. 5 is a perspective view showing a projected portion of a rotor disc and surrounding thereof according to one embodiment of the present invention.

Next, another embodiment of the present invention is shown in FIG. 5. The flange receiving recessed portion 523*a* is an annular groove formed over the whole circumference of the rotor disc 50*a* on the side wall face 522-1*a* of the binary flange receiving plane 522. Similarly, the flange receiving recessed portion 523*b* is an annular groove formed over the whole circumference of the rotor disc 50*b* on the side wall face 522-1*b* of the binary flange receiving plane 522. The flange receiving recessed portions 523*a*, 523*b* are flat on the respective bottoms, which makes it possible to form the groove more easily.

Figure 6A:
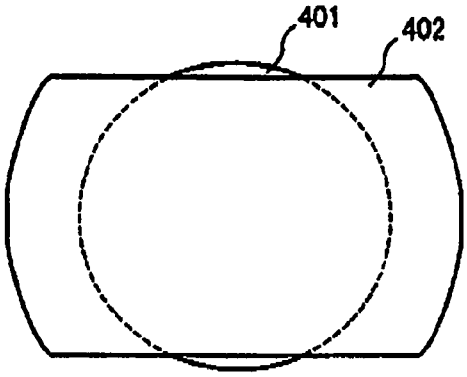
FIG. 6A is a plan view of an exemplified variation of a torque pin.
Figure 6B:
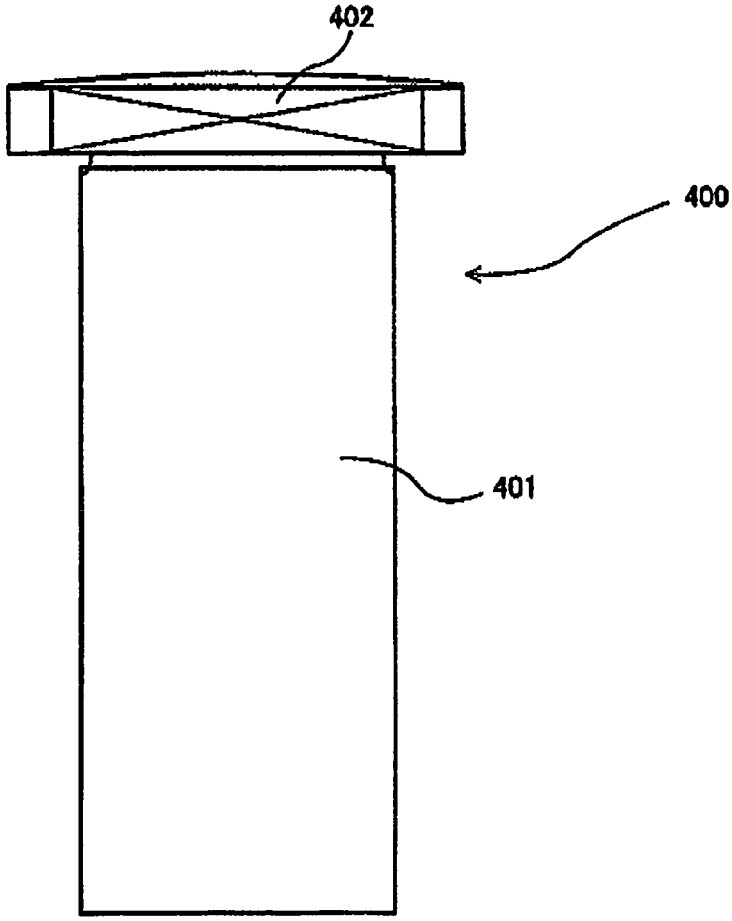
FIG. 6B is a side view of the exemplified variation of the torque pin.
Figure 7:
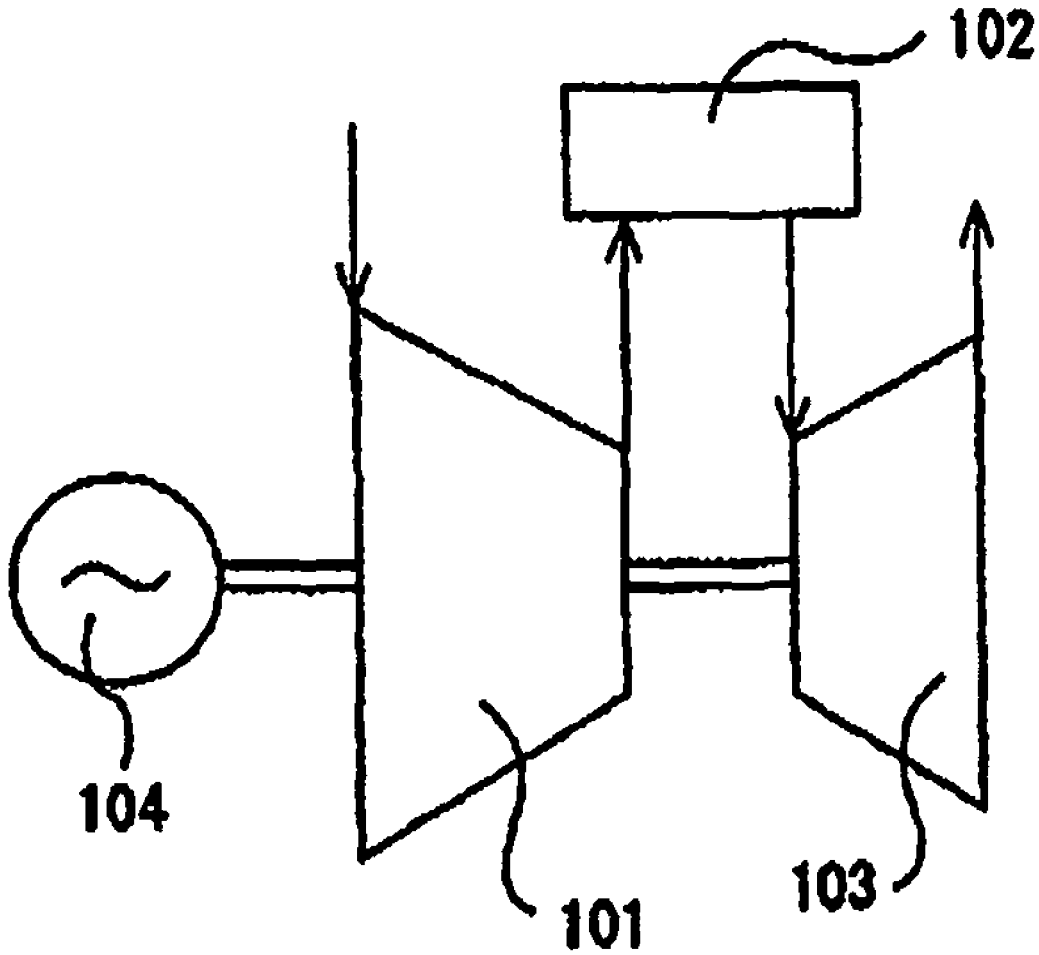
FIG. 7 is a conceptual diagram showing the general structure of a gas turbine.
Figure 8:
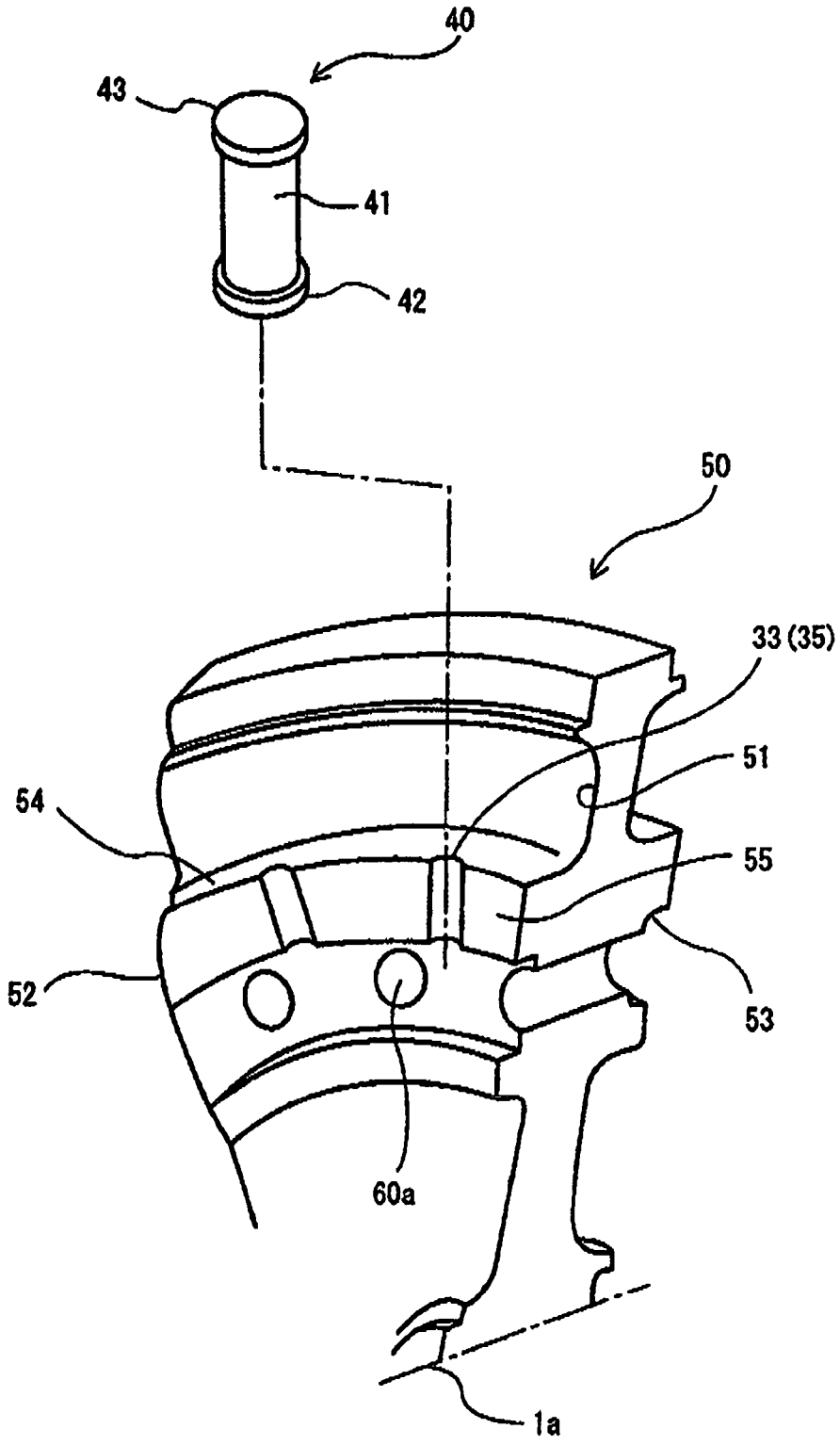
FIG. 8 is a sectional view showing major parts of a conventional rotor disc.
Figure 9:
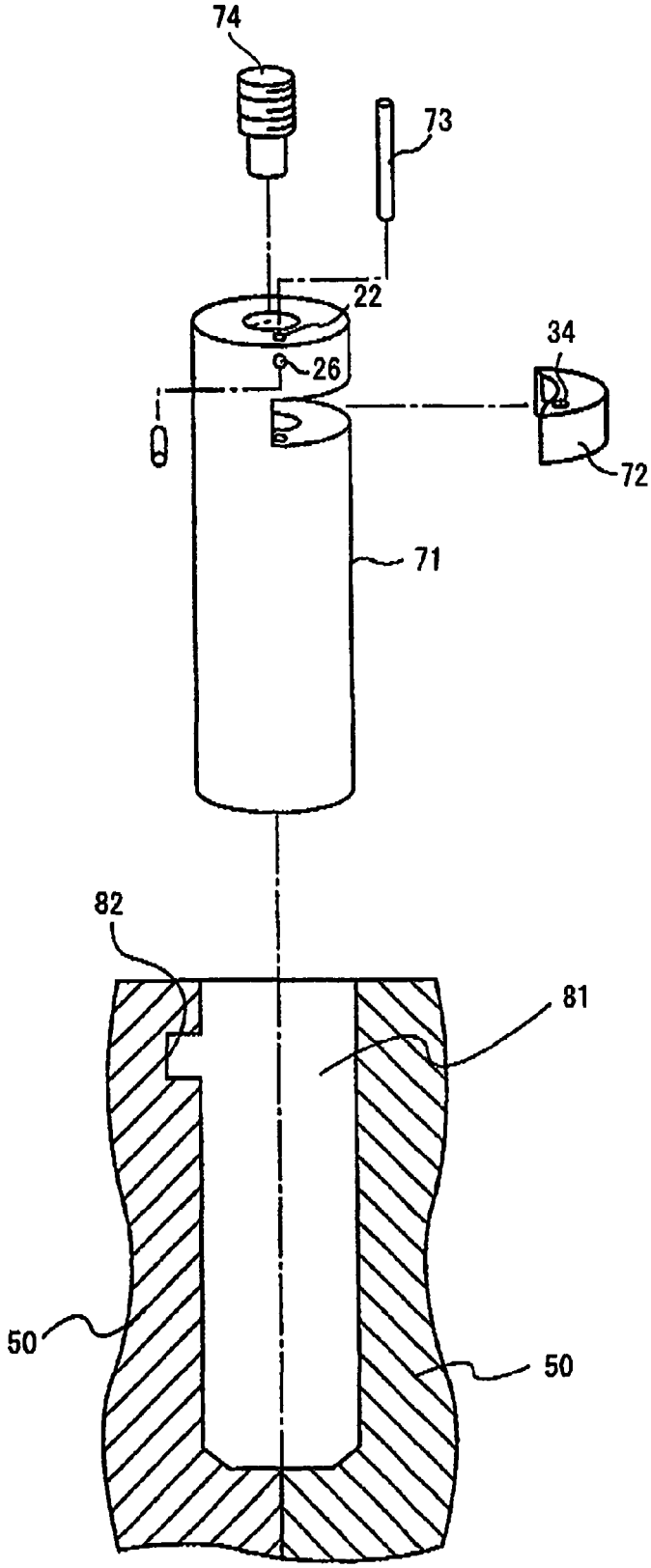
FIG. 9 is a partial sectional view showing a structure to install a torque pin of another conventional rotor disc.

An exemplified variation of the torque pin 400 is shown in FIG. 6A and FIG. 6B. The head top face 402*a* of the flange 402 is formed in a spherical shape. Since the inner faces of the flange receiving recessed portions 523*a*, 523*b* are in face contact with the head top face 402*a* of the flange 402, there is little chance that the inner faces of the flange receiving recessed portions 523*a*, 523*b* will be damaged. As a result, the occurrence of vibration for example, can be suppressed.

What is claimed is:

1. A turbine rotor which is provided with a torque transfer mechanisms equipped between a pair of adjacent first and second rotor discs among a plurality of rotor discs stacked in the axial line direction, with the centers in alignment with each other, and assembled in a single unit, for transferring a torque from the first rotor disc to the second rotor disc, the turbine rotor comprising:

a first contact face which is formed on the first rotor disc so as to face the second rotor disc;

a plurality of first grooves arranged on the first contact face, respectively separated from each other along the circumferential direction of the first rotor disc, respectively formed in the radial direction of the first rotor disc, and having a semi-circular cross section in orthogonal direction to the radial direction of the first rotor disc;

a second contact face which is formed on the second rotor disc so as to face the first rotor disc;

a plurality of second grooves which are arranged on the second contact face so as to be separated from each other along the circumferential direction of the second rotor disc, respectively formed in the radial direction of the second rotor disc, and having a semi-circular cross section in orthogonal direction to the radial direction of the second rotor disc;

a plurality of torque pins, each of which are inserted into each of a plurality of cylindrical holes formed between a pair of one of the first grooves which is in contact with the other one of the second grooves when the first rotor disc is arranged adjacent to the second rotor disc; and a binary flange receiving plane, composed of outer circumferences of the adjacent first and second rotor discs along the circumferential direction, wherein each of a plurality of the torque pins is provided with a columnar main body and a flange having a long side and a short side attached on the main body, the length of the long side of the flange is greater than the length of the binary flange receiving plane, the length of the short side of the flange is smaller than the width of the binary flange receiving plane, and a flange receiving recessed portion for receiving an end portion of a long side of the flange are formed respectively on two side faces of the pair of rotor discs.

2. The turbine rotor according to claim 1, wherein the flange is a plate approximately in a circular shape which has two circular arc-shaped short side and two linear long sides, in parallel to each other wherein the end portion of the long side are configured by two circular arc portions, and end portion of the short side is connected to the linear portion of the long side.

3. The turbine rotor according to claim 1, wherein the flange receiving recessed portion is formed in a groove shape and the distance between a pair of flange receiving recessed portions facing each other intervening the center of the cylindrical holes is greater than a length of a long side of the flange.

4. The turbine rotor according to claim 1, wherein the flange receiving recessed portion is an annular groove, wherein each center of the flange receiving recessed portion coincides with an axial center of the rotor disc.

5. The turbine rotor according to claim 1, wherein a first projected portion is formed on the outer circumference of one rotor disc along the circumferential direction thereof, a second projected portion is formed on the outer circumference of another rotor disc along the circumferential direction, the binary flange receiving plane is formed between the first projected portion and the second projected portion, and a pair of flange receiving recessed portions is formed respectively on a side face of the first projected portion of the first rotor disc and on a side face of the second projected portion of the second rotor disc, which is adjacent to the first rotor disc.

6. A turbine which is provided with the turbine rotors according to claim 1.

* * * * *